US007234546B2

(12) United States Patent
Vincent et al.

(10) Patent No.: US 7,234,546 B2
(45) Date of Patent: Jun. 26, 2007

(54) DRILLING AND CEMENTING CASING SYSTEM

(75) Inventors: Ray P. Vincent, Cypress, TX (US); Frank Koehrmann, Lachendorf (DE); George E. Givens, Spring, TX (US); Christiaan D. Krauss, Houston, TX (US); Edward T. Wood, Kingwood, TX (US); Friedhelm Makohl, Hermannsburg (DE); David B. Haughton, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 728 days.

(21) Appl. No.: 10/405,405

(22) Filed: Apr. 2, 2003

(65) Prior Publication Data

US 2004/0003944 A1 Jan. 8, 2004

Related U.S. Application Data

(60) Provisional application No. 60/370,910, filed on Apr. 8, 2002.

(51) Int. Cl.
*E21B 7/20* (2006.01)

(52) U.S. Cl. ..... 175/171; 175/7; 175/57

(58) Field of Classification Search ..... 175/171, 175/22, 7, 57; 166/358, 285, 289, 291
See application file for complete search history.

(56) References Cited

U.S. PATENT DOCUMENTS 2,929,610 A 3/1960 Stratton
3,256,936 A 6/1966 Johnson et al.
3,621,910 A 11/1971 Sanford et al.
3,984,991 A 10/1976 Kagler, Jr.
4,083,405 A 4/1978 Shirley
4,759,413 A 7/1988 Bailey et al.
5,497,840 A 3/1996 Hudson
5,613,567 A 3/1997 Hudson
6,223,823 B1 5/2001 Head
6,412,574 B1 * 7/2002 Wardley et al. ..... 175/7

FOREIGN PATENT DOCUMENTS

GB 2010360 A 9/1978

* cited by examiner

*Primary Examiner*—Jennifer H. Gay

*Assistant Examiner*—Giovanna M Collins

(74) *Attorney, Agent, or Firm*—Steve Rosenblatt

(57) ABSTRACT

A method and associated equipment are disclosed which allow drilling at least a portion of a well and subsequently cementing casing in a single trip. The method is particularly suited for deep-water offshore operations where the drill string can be run through a section of casing leaving a bit and an under-reamer extending out below. The casing is equipped with ports through which cement can be pumped as well as an external casing packer to prevent the uncured cement in the annulus from U-tubing. Several casing sections can be run in during drilling and cemented succession using the one trip method.

18 Claims, 10 Drawing Sheets

DRILLING AND CEMENTING CASING SYSTEM

PRIORITY INFORMATION

This application claims the benefit of U.S. Provisional Application No. 60/370,910 on Apr. 8, 2002.

FIELD OF THE INVENTION

The field of this invention is running in casing while drilling a well and cementing the casing in the same trip.

BACKGROUND OF THE INVENTION

When drilling offshore in deep water, particularly into zones having low formation pressure from adjacent formations with higher pressure and unstable formations, there was a serious risk of collapse of the drilled hole before casing could be inserted. In the long interval between getting the drill sting out and running in casing to tie back to existing casing in the wellbore, the collapse or unstable formations in the newly drilled area would make running casing virtually impossible. The solution that was developed was to drill down just short of the pay zone and pull out of the hole with the drill sting. The casing string that was next to be secured in the well was then suspended from the floating rig. This run of casing could be almost as long as the distance from the rig floor to the seabed. The drill string would then be run through this length of casing with the lower end having an under-reamer on top of a bit extending below the suspended casing string. A mud motor was used to rotate the lower end of the drill string, while the upper end remained fixed. The fixed portion of the drill string was secured to the casing and both advanced together downhole. Drilling into the pay zone would continue until the casing got stuck due to formation collapse around it, once the pay zone was breached. Depending on the formation characteristics of the pay zone the casing could get stuck due to borehole collapse around it as soon as a few feet after drilling into the zone. At that point the casing string was secured to the next size of casing with an external casing packer. The drill string was removed and a production string and packer were run. The last run of casing was not cemented because it couldn't be due to hole collapse around it.

It is well known that offshore deepwater rigs have very high daily rates. Accordingly, when drilling particularly in very deep water it would be advantageous to save rig time where possible.

The method of the present invention allows this to occur by making it possible to drill a portion of a well and in the same trip to cement that section of casing that is run in on the stationary portion of the drill string. In the preferred embodiment a mud motor drives an under-reamer and a bit that extend below the casing supported by the drill string. A cementing/inflation tool on the drill string engages with cementing ports in the casing to pass cement outside of the casing. The casing is secured to existing casing and the drill string is removed to complete the operation. Subsequent casing runs can be secured in the same fashion. Ultimately, a production string is secured to allow production. The process can be repeated for successive casing sizes. The process is even adaptable for use on land rigs after an initial depth is drilled, cased and cemented in the traditional manner. These and other beneficial aspects of the present invention will become more apparent to one skilled in the art from a review of the description of the preferred embodiment and the claims, which appear below.

SUMMARY OF THE INVENTION

A method and associated equipment are disclosed which allow drilling at least a portion of a well and subsequently cementing casing in a single trip. The method is particularly suited for deep-water offshore operations where the drill string can be run through a section of casing leaving a bit and an under-reamer extending out below. The casing is equipped with ports through which cement can be pumped as well as an external casing packer to prevent the uncured cement in the annulus from U-tubing. Several casing sections can be run in during drilling and cemented succession using the one trip method.

DETAILED DESCRIPTION OF THE PREFERRED EMBODIMENT

Figure 1:
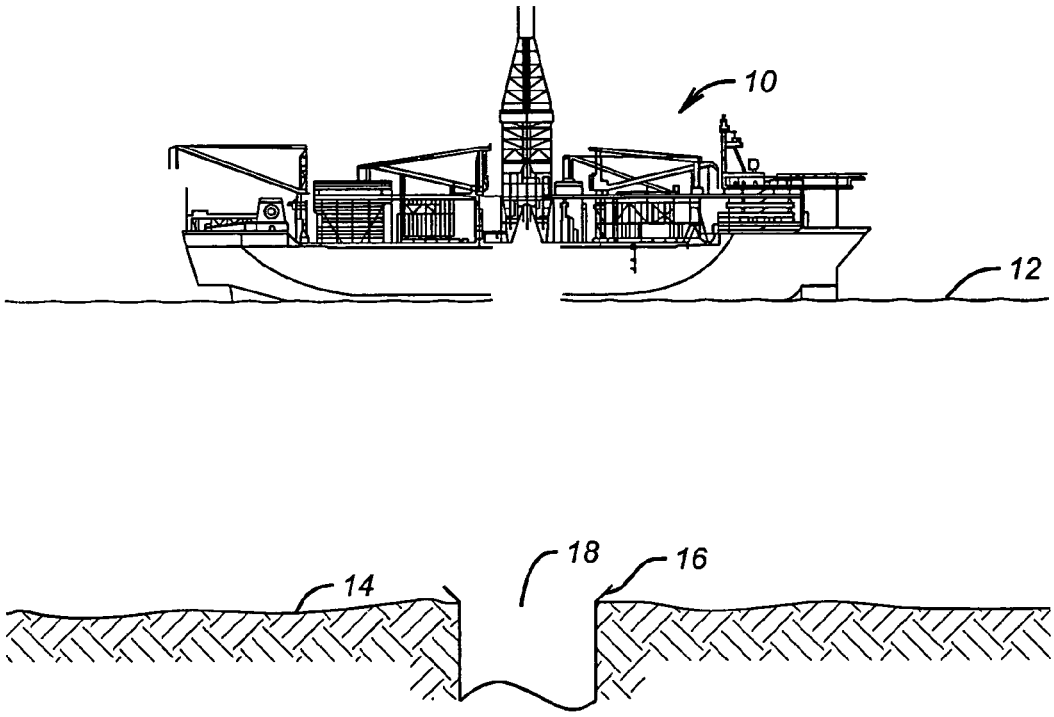
FIG. 1 is an offshore location showing the initial casing jetted into the seabed.

The method of the present invention is illustrated in FIGS. 1–13. FIG. 1 shows a drill ship or equivalent 10 sitting on the water 12. The seabed 14 has had initial casing 16 jetted into it leaving the beginning of a wellbore 18.

Figure 2:
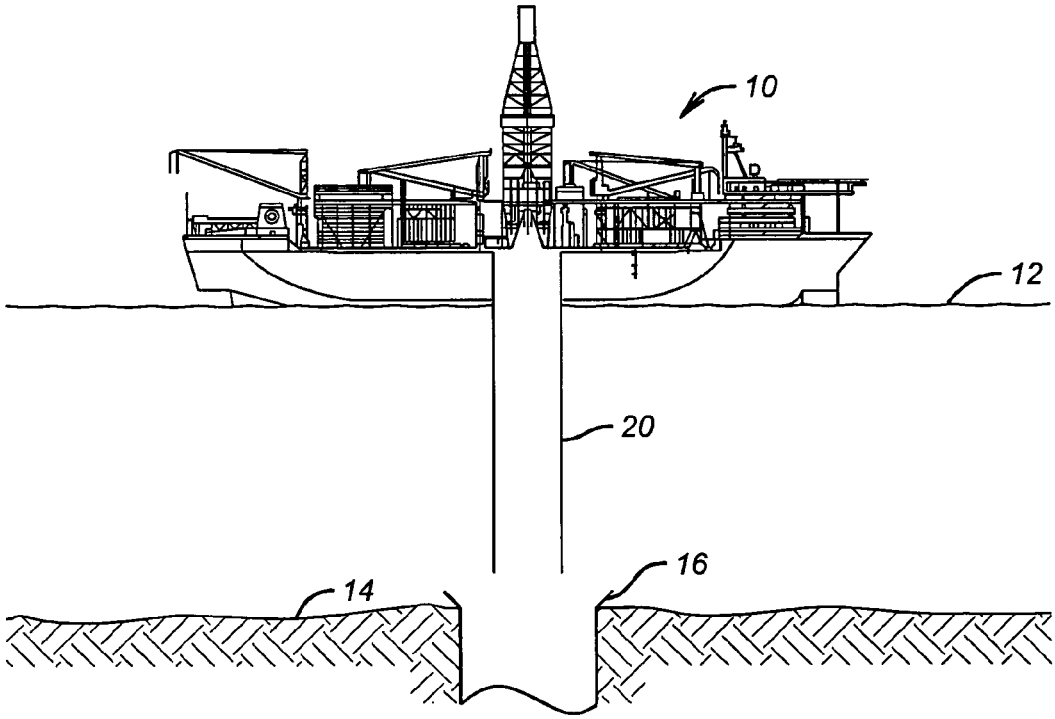
FIG. 2 shows the casing suspended from the drill ship.
Figure 3:
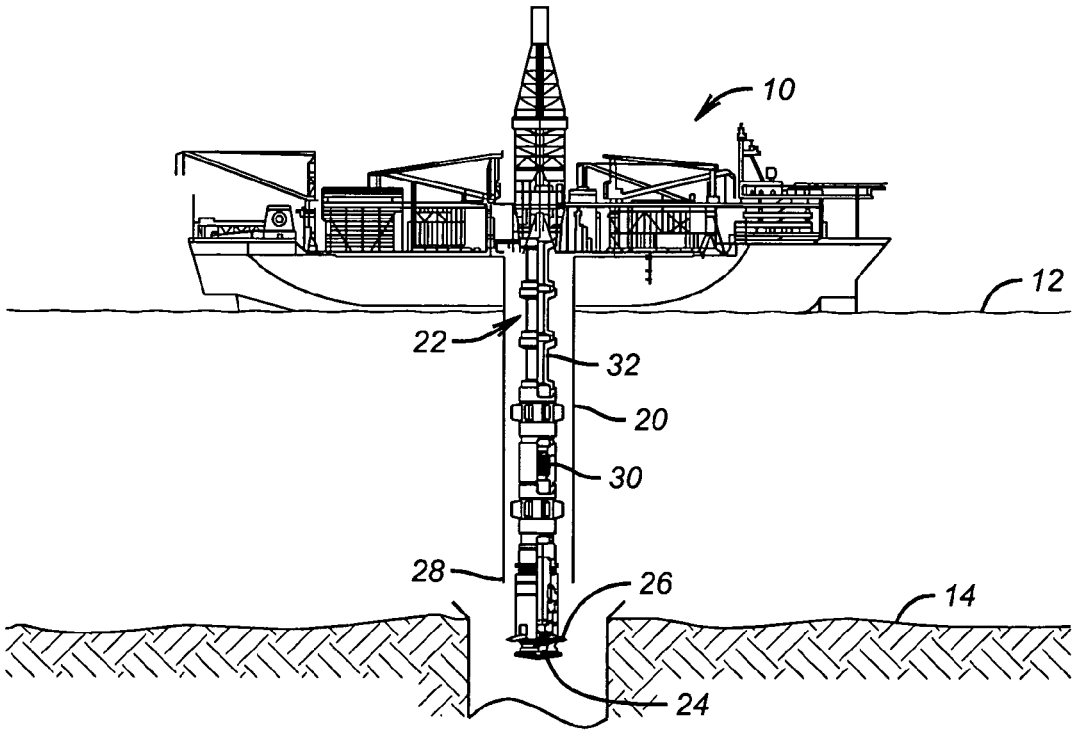
FIG. 3 shows the drill string run through the suspended casing.

In FIG. 2, a casing string 20 is put together and supported from the drill ship 10. The practical limit on its length is the approximate depth between the drill ship 10 and the seabed 14. As shown in FIG. 3, the drill string 22 is run through the casing string 20 such that a bit 24 and an under-reamer 26 extend out below the lower end 28 of the casing string 20. Ideally, the bit 24 should still clear the seabed 14 by a comfortable margin taking into account the expected wave action at the surface. A mud motor 30 drives the bit 24 and the under-reamer 26, leaving the upper end 32 of the drill string 22 stationary.

Figure 4:
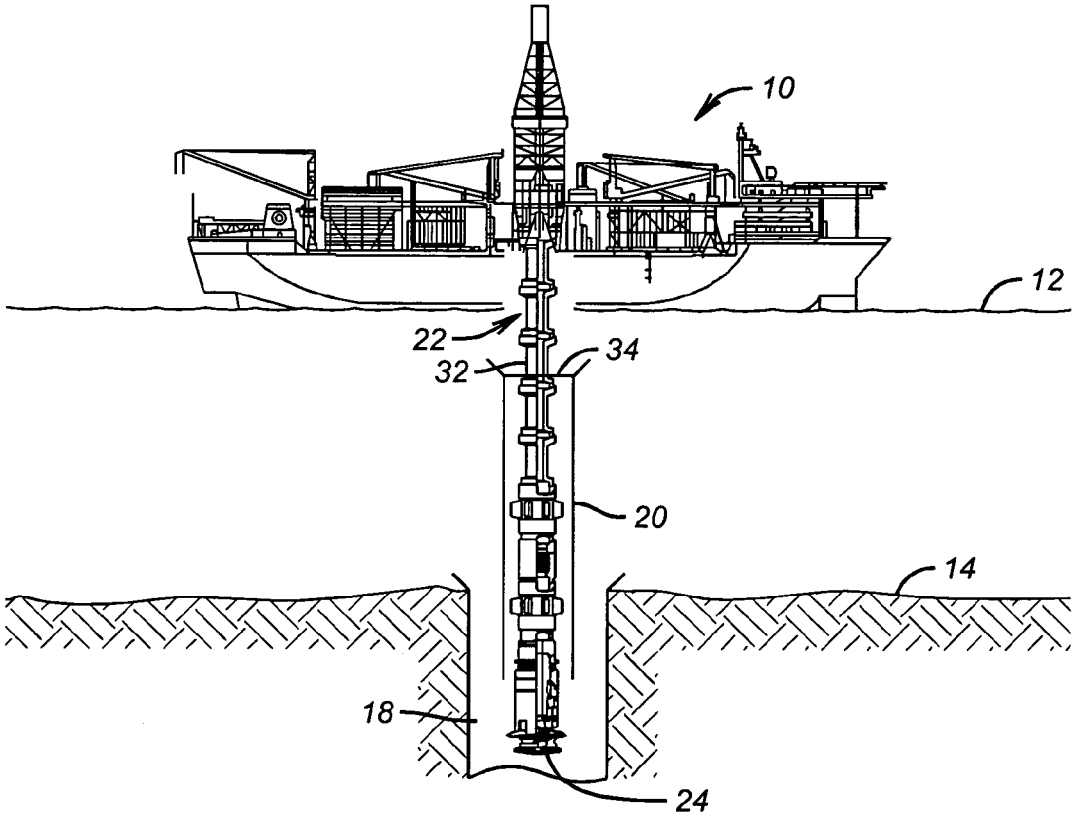
FIG. 4 the casing affixed to the stationary portion of the drill string.

FIG. 4 illustrates that the casing string 20 is secured to the upper end 32 of the drill string 22 by a connector 34 and the assembly is lowered to get bit 24 into the wellbore 18.

Figure 5:
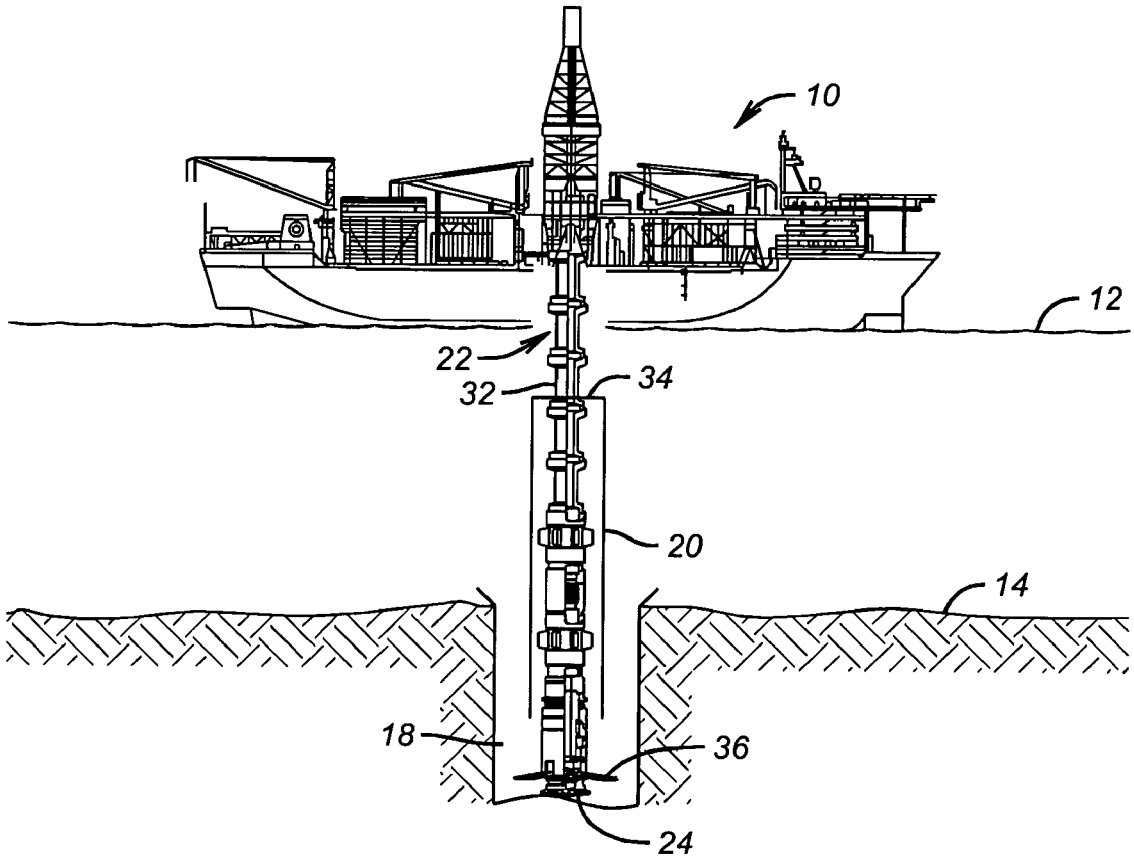
FIG. 5 shows the application of pressure to extend the arms of the under-reamer and to start the bit turning.
Figure 6:
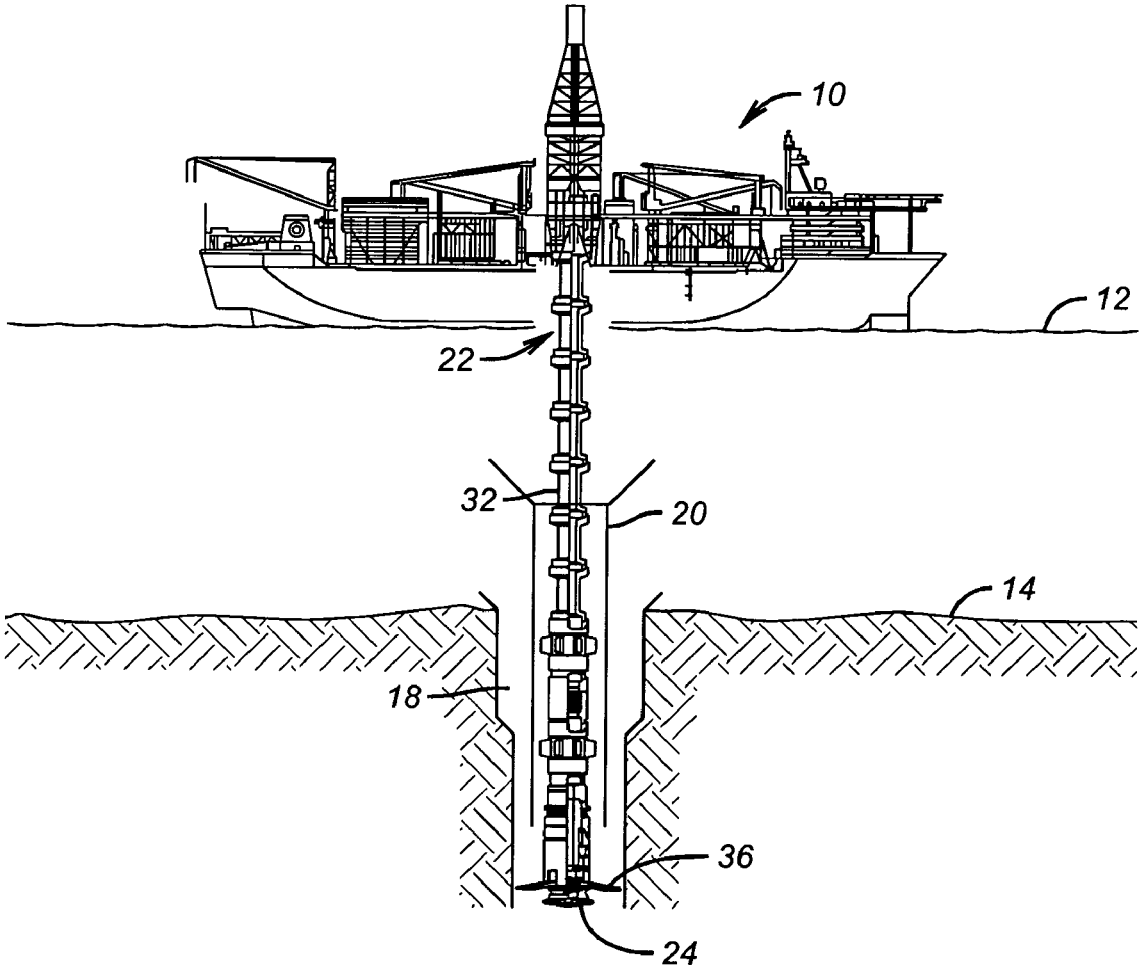
FIG. 6 shows drilling in progress.
Figure 7:
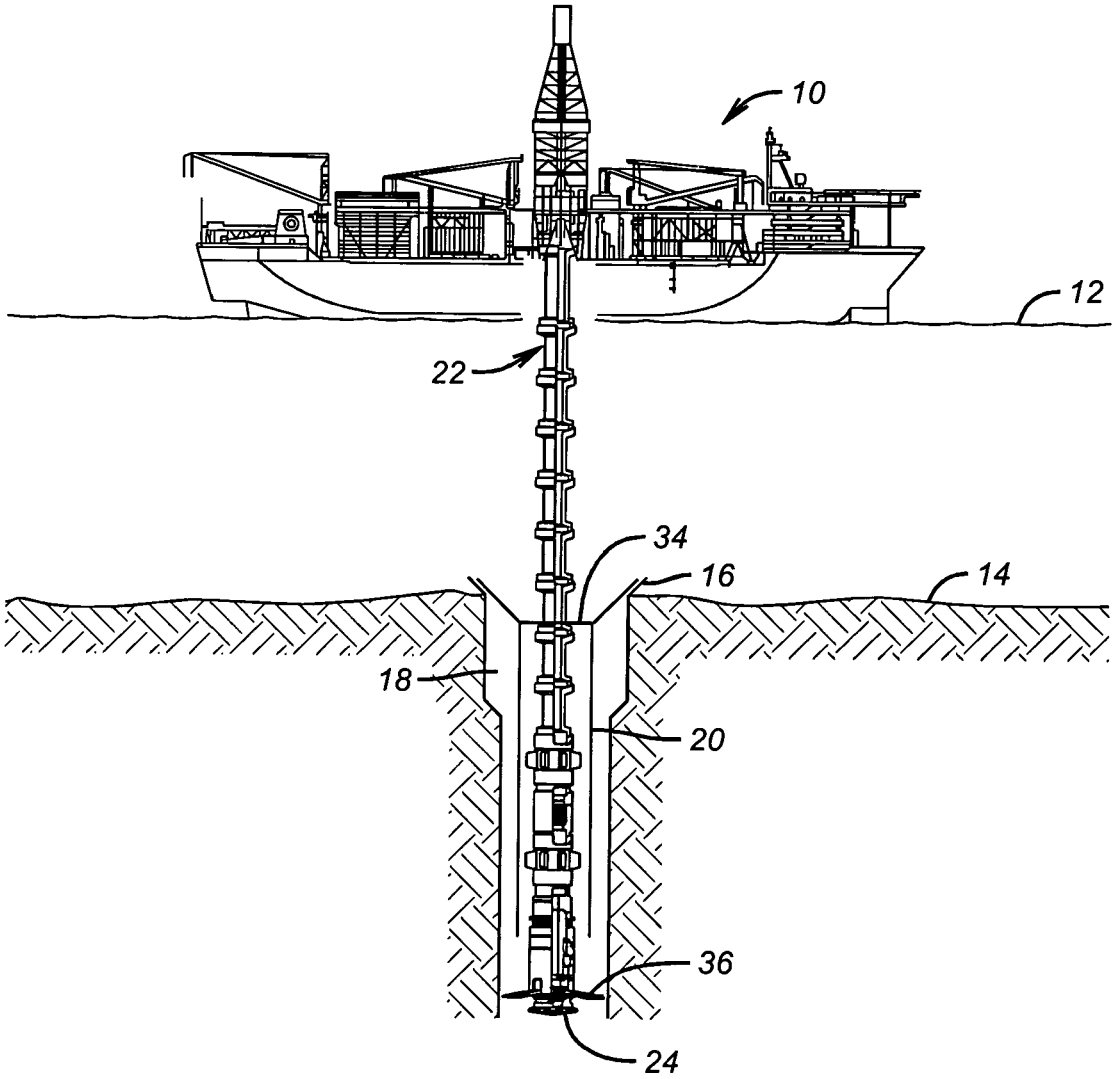
FIG. 7 shows the end of drilling progress as the casing suspended on the drill string lands on the previous casing string.

FIG. 5 illustrates pressure being applied in the drill string 22, which gets the under-reamer blades 36 to extend and starts the bit 24 turning. FIG. 6 shows drilling activity as the casing 20 descends with the advance of bit 24. FIG. 7 shows the maximum possible drilling depth, which is defined as the casing 20 contacts the initial casing 16. In view of coupling 34 connecting the drill string 22 to the casing 20, the bit cannot advance further when casing 20 is landed on initial casing 16.

Figure 8:
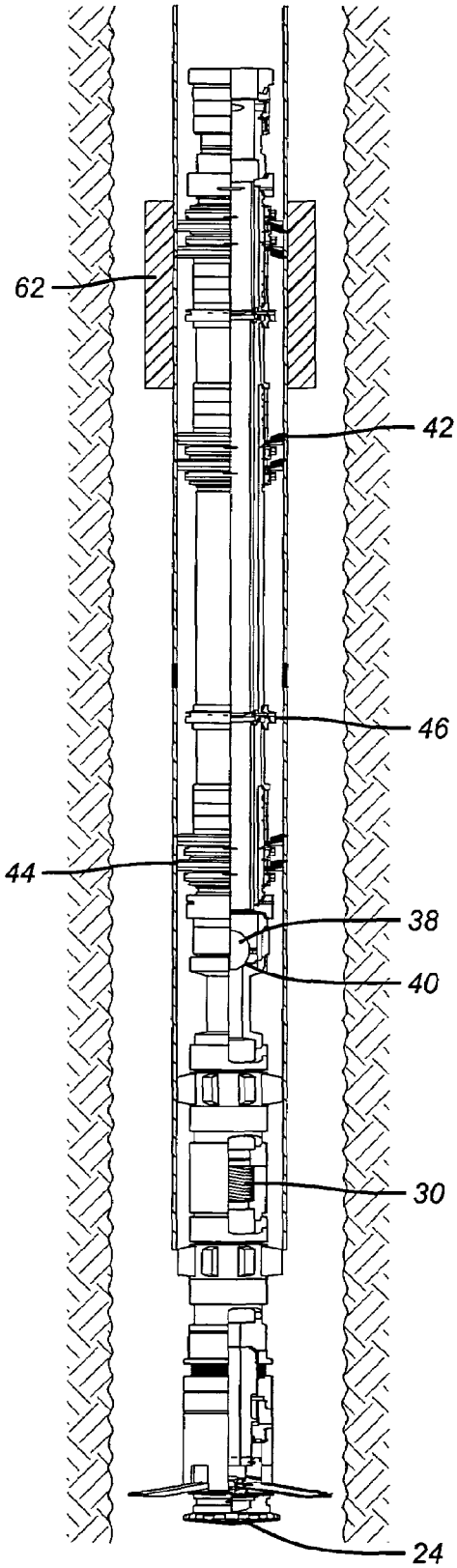
FIG. 8 shows the drilling motor isolated and pressure buildup to open the cementing ports.
Figure 9:
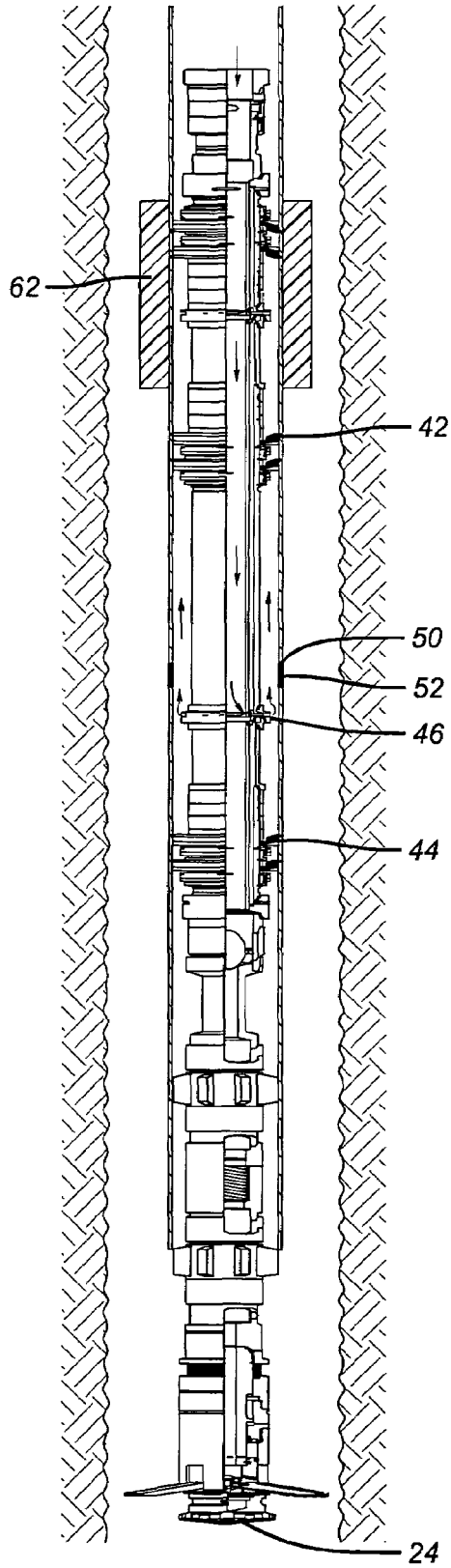
FIG. 9 shows the cementing ports open.
Figure 10:
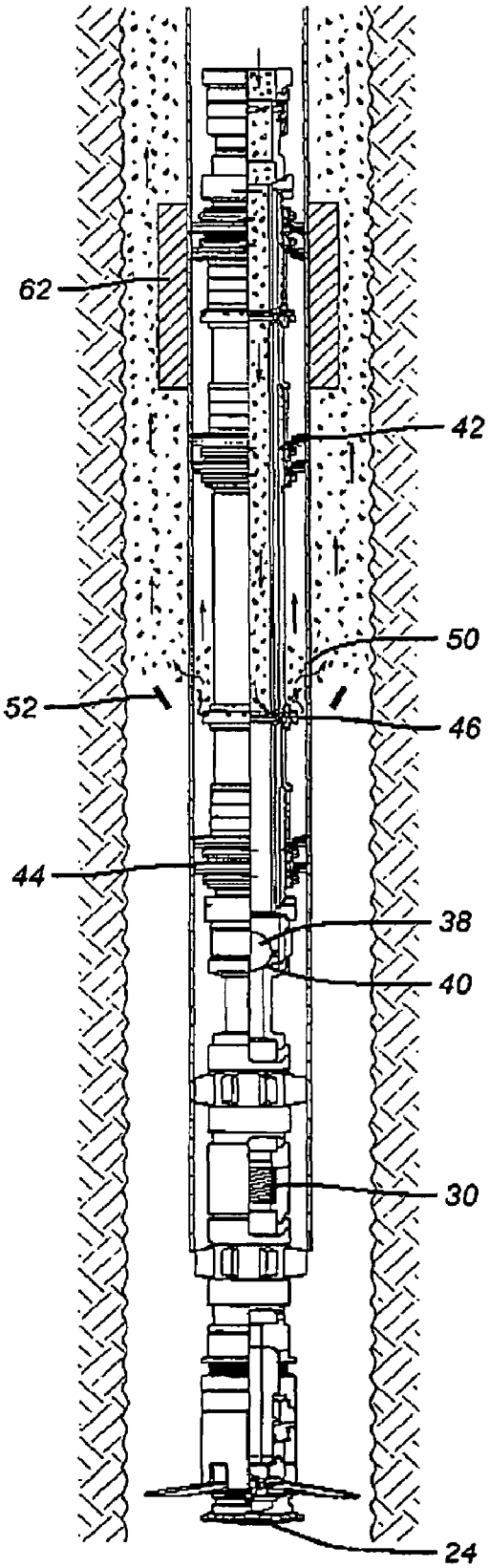
FIG. 10 shows cementing in progress.
Figure 11:
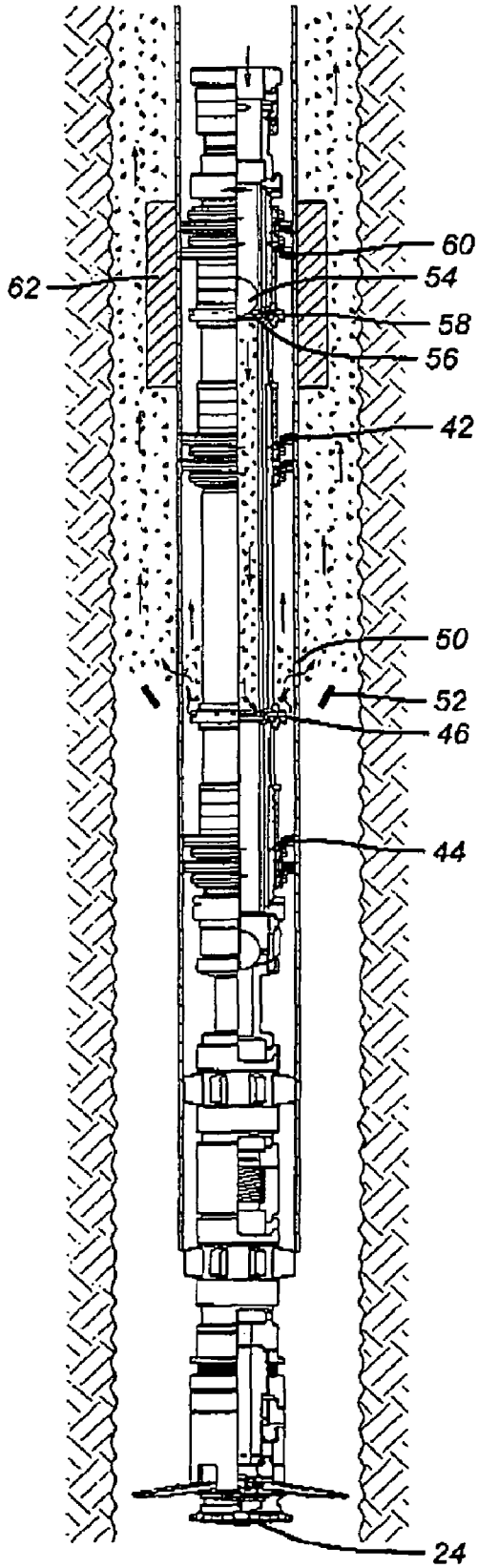
FIG. 11 shows the cementing ports isolated and the external casing packer inflated.
Figure 12:
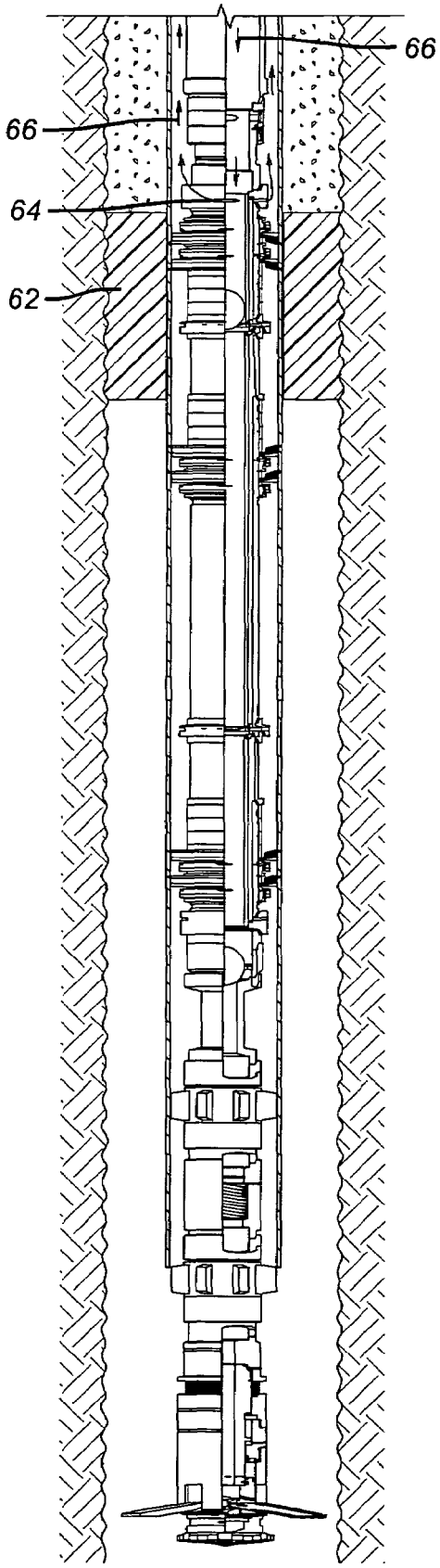
FIG. 12 shows the dump valves open and excess cement being circulated out.
Figure 13:
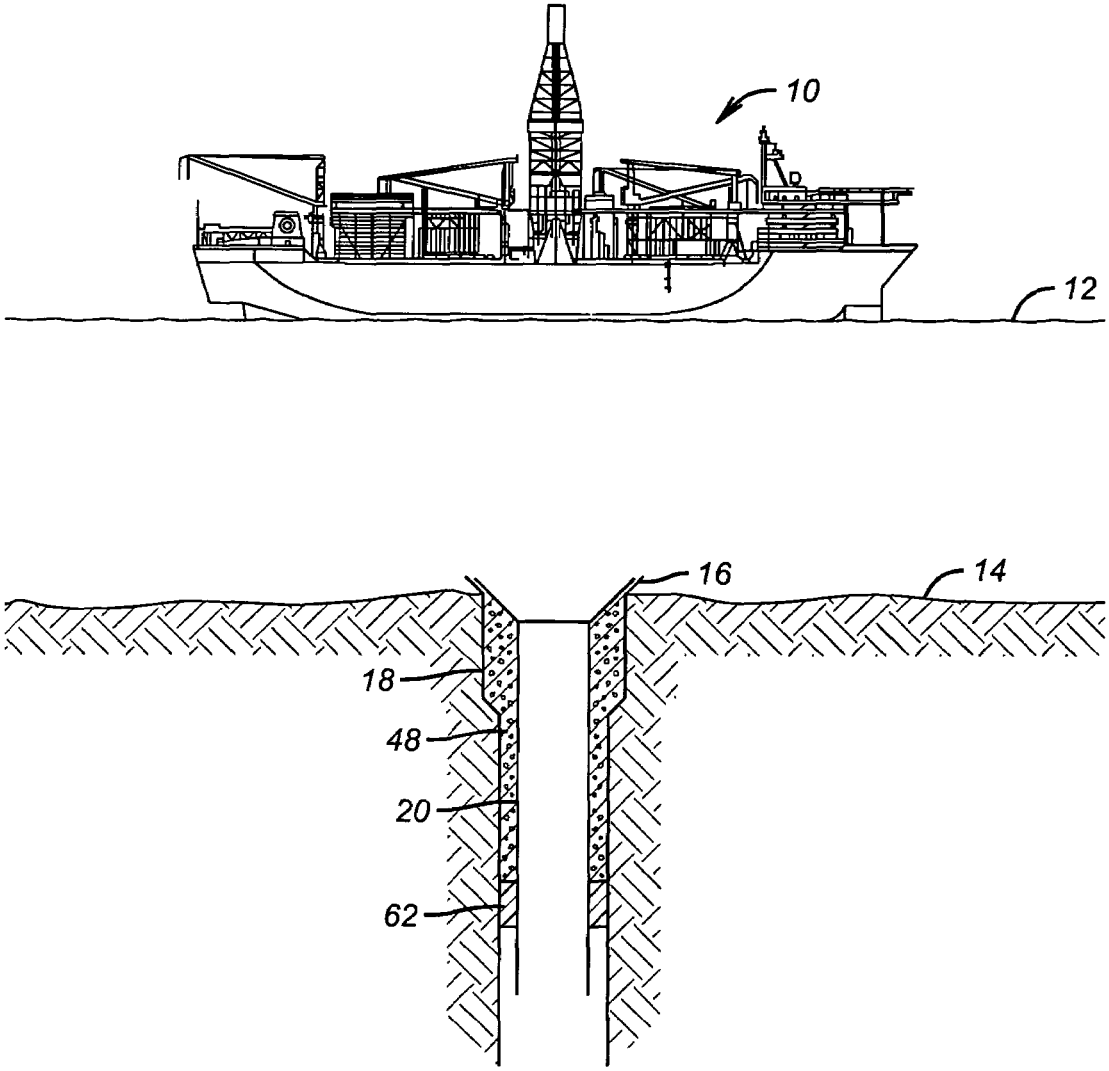
FIG. 13 shows the wellbore after the drill string is removed.

FIG. 8 shows a ball 38 dropped on a seat 40 to isolate the mud motor 30. Straddle seals 60 and 44 surround opening 46 in the drill string 22. FIG. 9 is the view of FIG. 8 with an internal sleeve that is connected to seat 40 shifted to open openings 46. FIG. 10 shows cement 48 going through an opening or openings 50 after a debris plug 52 is pushed out. FIG. 11 shows a plug 54 landing on a seat 56 to isolate openings 46. Pressure is now applied through openings 58 and between seals 60 and 42 into the external casing packer 62 to start it in its inflation cycle. FIG. 12 shows external casing packer 62 fully inflated and dump valve 64 triggered open. Excess cement in the drill string 22 can now be circulated out as shown by arrows 66. FIG. 13 shows the drill string 22 removed and the casing 20 fully cemented.

The process can be repeated for subsequent runs of casing. It can also be employed with land rigs after the well is initially drilled to a given depth. The previously described assembly can be inserted into the initially drilled well. In essence, the initial wellbore substitutes for the water depth, which, in an offshore application allows the first string to be cemented 20 to be run and cemented in a single trip to the initial casing 16. In a land rig environment, the counterpart to casing 20 would have to be run and cemented in the known way, with further casing strings run on drill pipe and cemented in a single trip.

Figure 14A:
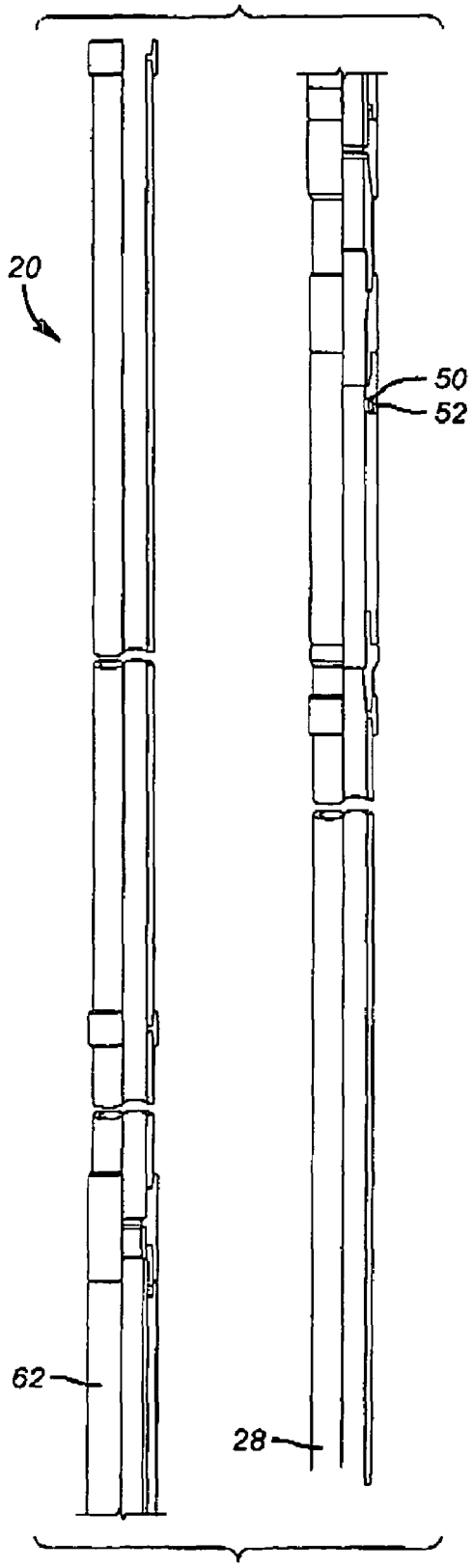
FIG. 14*a* is a part sectional elevation view of the casing.
Figure 14B:
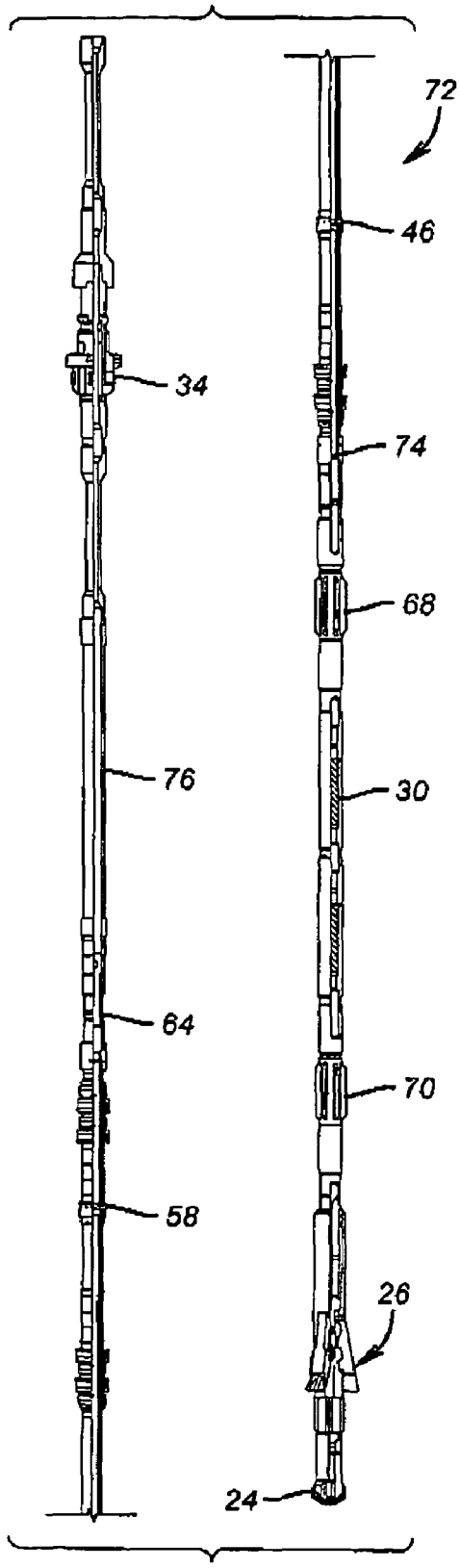
FIG. 14*b* is a sectional view of the drill string that passes through the casing.

Referring now to FIGS. 14*a*–14*b*, the casing string 20 is illustrated. It has an external casing packer 62 as well as openings 50 through which cement is pumped after the optional debris plugs 52 are knocked out.

The drill string 22 is illustrated along side for clarity but it is actually assembled within casing 20. Starting at the lower end and working uphole, the bit 24 has an under-reamer 26 above it. These two tools extend beyond the lower end 28 of the casing string 20. Mud motor 30, with stabilizers 68 and 70 above and below it, is mounted above the under-reamer 26. Above the stabilizer 68 are seal assemblies 44, 42, and 60 respectively. They are part of an inflation/cementing tool 72, which further includes openings 46 and 58 as well as dump valve 64. Ball catcher sub 74 includes seat 40 (see FIG. 8), which is used to isolate the mud motor 30 when ball 38 is dropped on it. Going further uphole, there are drill collars 76 and the connector 34 (see FIG. 4) followed by the rest of the drill string 22 to the drill ship 10.

The individual components are not described in detail because they are known to those skilled in the art. Rather the invention relates to the assembly of the components and the one trip method they make possible for drilling and cementing or otherwise sealing casing in a single trip. The presence of the casing during drilling also provides protection against sticking the drill string in the event of a borehole collapse. This situation is more likely to occur when drilling from a zone of higher pressure to one of significantly lower pressure or an unstable formation. The method and equipment can be used on land rigs, but the significantly higher daily rates of offshore rigs and drill ships makes the application of the method and apparatus to offshore installations more financially compelling.

The above description is illustrative of the preferred embodiment and many modifications may be made by those skilled in the art without departing from the invention whose scope is to be determined from the literal and equivalent scope of the claims below:

We claim:

1. A one trip drilling and casing cementing method, comprising:

providing a drilling assembly on a drill string;

supporting casing, defining a casing wall, from the drill string so that said drilling assembly extends below the lower end of the casing;

lowering the drilling assembly and casing in one trip on said drill string;

drilling the well while advancing the casing;

delivering cement through at least one first opening in said casing wall; and forcing the cement into the annular space between the casing and the wellbore.

2. The method of claim 1, comprising:

advancing said drilling assembly downhole; and supporting said casing on a non-rotating portion of the drill string.

3. The method of claim 2, comprising:

using a downhole motor to drive the drilling assembly; and providing a drill bit and under-reamer as at least a portion of said drilling assembly.

4. A one trip drilling and casing cementing method, comprising:

providing a drilling assembly on a drill string;

supporting casing from the drill string so that said drilling assembly extends below the lower end of the casing;

lowering the drilling assembly and casing in one trip on said drill string;

drilling the well while advancing the casing;

delivering cement through at least one first opening in the casing;

forcing the cement into the annular space between the casing and the wellbore;

locating said at least one first opening in the casing wall;

delivering cement through at least one first opening in the wall of said drill string.

5. The method of claim 4, comprising:

delivering at least one isolator on said drill string to close an annular gap between said first opening in said drill string and said first opening in said casing wall; and using said isolator to force cement from the drill string through said first opening in said casing wall.

6. The method of claim 5, comprising:

providing a removable plug in said first opening in said casing wall.

7. The method of claim 6, comprising:

forcing said plug out with cement.

8. The method of claim 4, comprising:

isolating said drilling assembly from pressure in said drill string;

thereafter increasing pressure in said drill string to open said first opening in said drill string wall.

9. The method of claim 8, comprising:

delivering at least one isolator on said drill string to close an annular gap between said first opening in said drill string and said first opening in said casing wall; and using said isolator to force cement from said first opening in said drill string through said first opening in said casing wall.

10. The method of claim 9, comprising:

providing an external annulus barrier on said casing;

actuating said annulus barrier after delivery of cement from said opening in the wall of said casing.

11. The method of claim 10, comprising:

proving at least one second opening in the wall of said drill string and a second opening in the wall of said casing;

isolating an annular space between said second opening on said wall of said drill string and said wall of said casing;

actuating said external annulus barrier through said annular space.

12. The method of claim 11, comprising:

isolating said first opening in said drill string from said second opening in said drill string before actuating said annulus barrier.

13. The method of claim 12, comprising:

providing a selectively opened third opening on the wall of said drill string;

raising pressure in said drill string after actuating said annulus barrier;

selectively opening said third opening with said drill string pressure; and removing cement from said drill string.

14. The method of claim 8, comprising:

providing an annulus barrier on said casing;

actuating said annulus barrier after delivery of cement from said opening in the wall of said casing.

15. The method of claim 14, comprising:

removing cement from said drill string after actuating said annulus barrier.

16. The method of claim 15, comprising:

removing said drill string and drilling assembly from the wellbore.

17. The method of claim 16, comprising:

advancing said drilling assembly downhole; and supporting said casing on a non-rotating portion of the drill string.

18. The method of claim 17, comprising:

using a downhole motor to drive the drilling assembly; and providing a drill bit and under-reamer as at least a portion of said drilling assembly.

* * * * *